US005939838A

United States Patent [19]

Janik

[11] Patent Number: 5,939,838

[45] Date of Patent: Aug. 17, 1999

[54] FERRORESONANT TRANSFORMER BALLAST FOR MAINTAINING THE CURRENT OF GAS DISCHARGE LAMPS AT A PREDETERMINED VALUE

[75] Inventor: Raymond G. Janik, Bloomingdale, Ill.

[73] Assignee: Shape Electronics, Inc., Addison, Ill.

[21] Appl. No.: 08/866,743

[22] Filed: May 30, 1997

[51] Int. Cl.[6] ..... H05B 37/02

[52] U.S. Cl. ..... 315/277; 315/291; 315/307; 315/308

[58] Field of Search ..... 315/277, 291, 315/307, 308; 323/248

[56] References Cited

U.S. PATENT DOCUMENTS

| | | | |
|---|---|---|---|
| 3,500,128 | 3/1970 | Liepins . | |
| 3,573,606 | 4/1971 | Hart et al. | 323/48 |
| 3,611,021 | 10/1971 | Wallace | 315/307 |
| 3,739,257 | 6/1973 | Hunter | 323/50 |
| 3,781,630 | 12/1973 | Ballman | 320/21 |
| 4,142,141 | 2/1979 | Hase | 323/6 |
| 4,156,175 | 5/1979 | Nissan | 323/60 |
| 4,439,722 | 3/1984 | Budnik | 323/248 |
| 4,465,966 | 8/1984 | Long et al. | 323/248 |
| 4,806,834 | 2/1989 | Koenig | 318/523 |
| 5,117,176 | 5/1992 | Bobry | 323/308 |
| 5,216,333 | 6/1993 | Wucholls . | |
| 5,539,300 | 7/1996 | Mathieu | 323/249 |

*Primary Examiner*—Michael B Shingleton
*Attorney, Agent, or Firm*—McCormick, Paulding & Huber

[57] ABSTRACT

A ferroresonant ballast for regulating the current level of gas discharge lamps includes a magnetic core for supporting coil windings. A first or input coil is wound about the magnetic core for supplying a changing input voltage. A second or capacitor coil is wound about the magnetic core and is induced by the first coil to generate an output voltage across an output or resonant capacitor. A third or lamp coil is wound about the magnetic core and coupled to a gas discharge lamp which is regulated at a constant voltage in response to the voltage generated across the output capacitor. The ferroresonant ballast may include a control circuit and inductor that is switchable coupled to the output capacitor for simulating core saturation.

14 Claims, 6 Drawing Sheets

FERRORESONANT TRANSFORMER BALLAST FOR MAINTAINING THE CURRENT OF GAS DISCHARGE LAMPS AT A PREDETERMINED VALUE

CROSS REFERENCE TO RELATED PATENT

This application incorporates by reference the disclosure in U.S. Pat. No. 3,573,606 issued to Kakalec.

BACKGROUND OF THE INVENTION

The present invention relates to lamp ballasts, and deals more particularly with a ferroresonant transformer ballast for regulating the current of gas discharge lamps.

The current-voltage characteristics of gas discharge lamps, such as mercury vapor lamps, is nonlinear where the voltage is relatively constant over a range of lamp current which makes a voltage source an unsuitable power source. A current source, on the other hand, has a high output impedance which allows the source voltage to follow the lamp voltage. As shown in FIG. 1, a commonly used method to energize a gas discharge lamp 10 is by means of a variable or alternating voltage source $V_{in}$ and a ballast 12 coupled in series with the lamp 10 in order to limit the current and to bear the voltage difference between the lamp and the voltage source. However, this method leaves the lamp current, and therefore the lamp output power, sensitive to changes in the input voltage and also reduces the input power factor.

Another method to energize a gas discharge lamp is to use a ferroresonant transformer as an alternating voltage source which has additional benefits as the method described with respect to FIG. 1. Ferroresonant technology, in general, is known for voltage regulation. For example, U.S. Pat. No. 3,573,606 to Kakalec, the teaching of which is herein incorporated by reference, teaches a ferroresonant voltage regulator. Ferroresonant transformers maintain a constant output voltage, limit the output current and improve the input power factor. FIG. 2 schematically illustrates a constant voltage ferroresonant transformer 14. The ferroresonant transformer 14 includes an E-shaped piece 16 and an I-shaped piece 18 cooperating to form a core. An input coil 20 is wound around a center leg 22 of the E-shaped piece 16, and a capacitor coil 24 is wound around a secondary core portion of the center leg 22. An output capacitor (not shown) is coupled in series with the capacitor coil 24. A leakage inductance shunt 26, positioned generally at a longitudinal midpoint of the center leg 22, cooperates with an opposing surface of the E-shaped piece 16 to define an air gap 28.

FIG. 3 schematically illustrates an equivalent electrical circuit of the ferroresonant transformer 14 of FIG. 2, where coils 30 represent the input coil, an inductance 32 having reactance $X_S$ represents the leakage inductance, an inductance 34 having reactance $X_M$ represents the saturable inductance of a secondary portion of the core where the capacitor coil 24 is wound, coils 36 represent the capacitor coil, and capacitor 38 having voltage $V_C$ is the output or resonance capacitor. Regulation is achieved as follows: any increase in the capacitor voltage $V_C$ will further saturate whereby the value of $X_M$ is decreased. A decrease in the value of $X_M$ will also decrease the equivalent capacitance, and in turn decrease the resonant gain. Conversely, any decrease in $V_C$ will reduce the degree of saturation of the core whereby the value of $X_M$ is increased. An increase in the value of $X_M$ will also increase the equivalent capacitance, and in turn will increase the resonant gain. The capacitor root-mean-square (RMS) current is virtually constant over a range of input voltage. As shown in FIG. 4, if a lamp 40 is inserted in series with the output capacitor 38, the capacitor current will adequately energize the lamp 40 provided that the open circuit voltage (the voltage level just before the lamp 40 ignites) is high enough to cause the lamp 40 to strike. The lamp current can be varied by changing the capacitive value of the resonant capacitor 38 which is usually accomplished by interchanging capacitors of varying capacitance.

The saturated core of the ferroresonant transformer increases the crest factor ($V_{peak}/V_{rms}$) of the lamp current which shortens the lamp's operating life and makes it difficult for metal additive lamps to remain lit. Low grade steel reduces the magnitude of the peak capacitor current which makes it the preferred choice for laminations in spite of the higher core losses and reduced efficiency. High power lamps require a high voltage across its terminals. Since the output capacitor 40 is in series with the lamp, as shown in FIG. 4, the output capacitor 40 has to be rated for the same voltage as the lamp. High voltage capacitors are more expensive, more difficult to source, and are physically larger than the standard 660 V type.

It is therefore an object of the present invention to provide a ferroresonant ballast that overcomes the disadvantages associated with prior ballasts for regulating the current of gas discharge lamps.

SUMMARY OF INVENTION

The present invention resides in a ferroresonant transformer ballast for regulating the current of gas discharge lamps. The ballast comprises a magnetic core for supporting coil windings. A first or input coil is wound about the magnetic core and energizable from a variable source for supplying input voltage and current. A second or capacitor coil is wound about the magnetic core and magnetically coupled to the first coil so as to induce a voltage across terminals of the second coil in response to a change in current from the first coil. An output capacitor is connected across the terminals of the second coil for resonance. A third or lamp coil is wound about the magnetic core and magnetically coupled to the second coil so as to induce a voltage across terminals of the third coil in proportion to the average voltage across the output capacitor. At least one gas discharge lamp is connected across terminals of the third coil whereby a current level of the gas discharge lamp is regulated in response to the average voltage of the output capacitor.

The ferroresonant ballast may also include a control circuit and a control inductor that is switched into and out of electrical contact with the output capacitor in order to simulate core saturation and to maintain the current of the lamp at a generally constant or steady state value.

One advantage of the present invention is that the ferroresonant ballast provides a low crest factor of the lamp current, whereby permitting the ferroresonant ballast to be used with metal additive lamps without any design changes or modifications. Furthermore, any type of lamination can be used from low grade strip steel to high grade "EI" lamination.

Other objects and advantages of the present invention will become apparent in view of the following detailed description and accompanying drawings.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENTS

Figure 5:
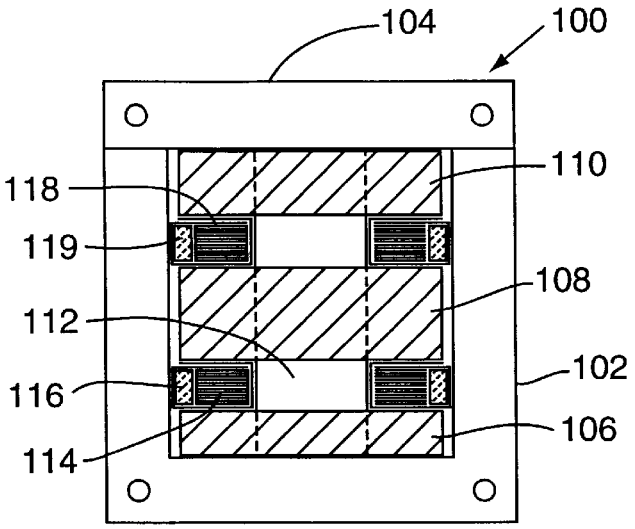
FIG. 5 schematically illustrates an uncontrolled ferroresonant transformer ballast fabricated from E-shaped and I-shaped laminations according to the present invention.

Turning now to FIG. 5, an uncontrolled ferroresonant transformer ballast is generally designated by the reference number 100. The ferroresonant transformer ballast 100 includes an E-shaped piece 102 and an I-shaped piece 104. An input coil 106, capacitor coil 108 and lamp coil 110 are spaced from each other and wound around a center leg 112 of the E-shaped piece 102. A leakage inductance magnetic shunt 114 is positioned around the center leg 112 at a longitudinal location between the input coil 106 and the capacitor coil 108. The leakage inductance shunt 114 cooperates with an opposing surface of the E-shaped piece 102 to define a first shunt air gap 116. A lamp choke magnetic shunt 118 is positioned around the center leg 112 at a longitudinal location between the capacitor coil 108 and the lamp coil 110. The lamp choke shunt 118 cooperates with an opposing surface of the E-shaped piece 102 to define a second shunt air gap 119.

Figure 1:
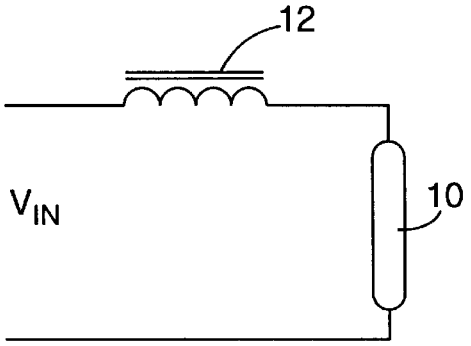
FIG. 1 PRIOR ART
FIG. 1 schematic illustrates a conventional ballast used with a discharge lamp.
Figure 2:
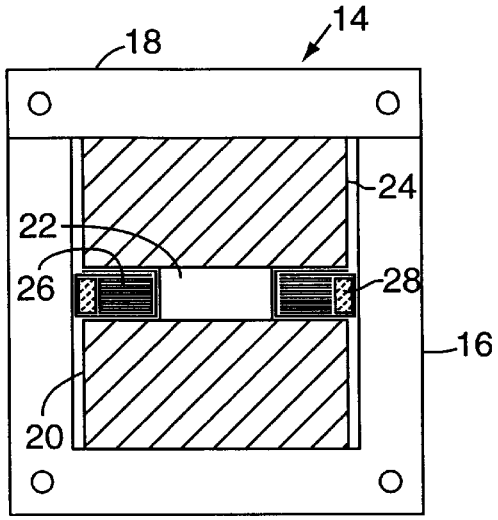
FIG. 2 PRIOR ART
FIG. 2 schematically shows a conventional ferroresonant transformer.
Figure 3:
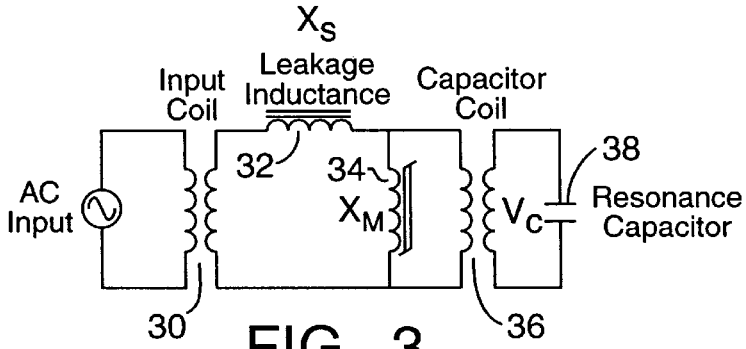
FIG. 3 PRIOR ART
FIG. 3 schematically illustrates an equivalent electrical circuit of the ferroresonant transformer of FIG. 2.
Figure 4:
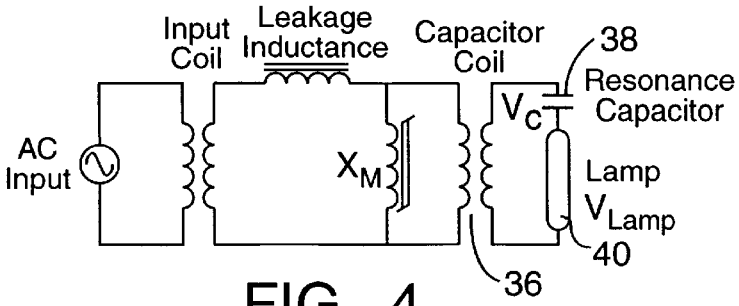
FIG. 4 PRIOR ART
FIG. 4 schematically illustrates an equivalent electrical circuit of the ferroresonant transformer of FIG. 2 powering a gas discharge lamp.

An output capacitor (not shown) is to be coupled across the terminals of the capacitor coil 108, and a lamp (not shown) is to be coupled across the terminals of the lamp coil 110. Consequently, the lamp coil 110 (as distinct from the capacitor coil 108) serves to isolate the lamp from the output capacitor. Further, the lamp choke shunt 118 serves as a choke in series with the lamp. Unlike the prior ferroresonant transformer shown by the equivalent electrical circuit in FIG. 4, the lamp current as used with the ferroresonant transformer ballast 100 of FIG. 5 has a lower crest factor due to the leakage inductance contributed by the lamp choke shunt 118. The lower crest factor permits the use of any type of lamination for the ferroresonant transformer ballast core from a low grade strip steel (see FIG. 6) to a high grade "EI" lamination as shown in FIG. 5.

Figure 6:
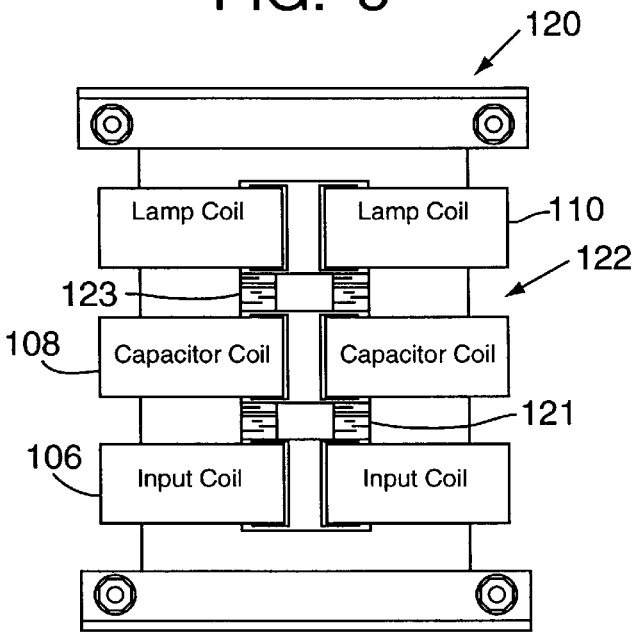
FIG. 6 schematically shows a ferroresonant transformer ballast fabricated from strip steel in accordance with another embodiment of the present invention.

With reference to FIG. 6, a ferroresonant transformer ballast 120 has like reference numbers for like parts with the ferroresonant transformer ballast 100 of FIG. 5. The ferroresonant transformer ballast 120 differs from the ferroresonant transformer ballast 100 of FIG. 5 in that the ballast 120 has a core 122 fabricated from strip steel as opposed to the E and I—shaped pieces 102, 104 used for the ferroresonant transformer ballast 100 of FIG. 5. The ferroresonant transformer ballast 120 further includes an input coil 106, capacitor coil 108, lamp coil 110, leakage inductance magnetic shunt 121 and lamp choke magnetic shunt 123.

Figure 7:
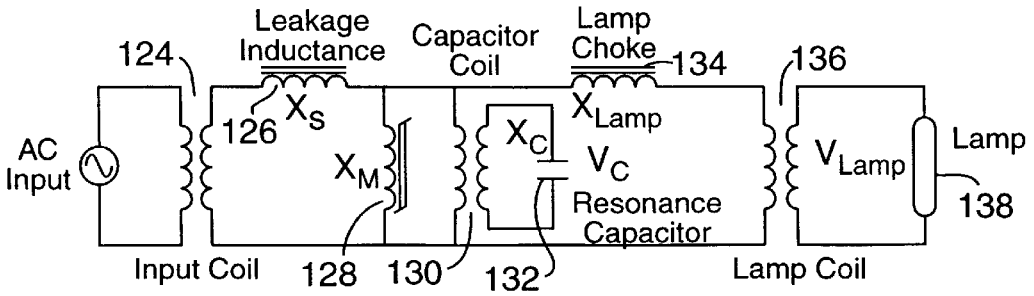
FIG. 7 schematically illustrates an equivalent electrical circuit of the ferroresonant transformer ballasts of FIGS. 5 and 6.

FIG. 7 is the equivalent electrical circuit of the integrated ferroresonant transformer ballasts shown in FIGS. 5 and 6, where coils 124 represent the input coil, an inductance 126 having reactance $X_S$ represents the leakage reactance, an inductance 128 having reactance $X_M$ represents the saturable magnetizing reactance of the core, coils 130 represent the capacitor coil, a capacitor 132 having capacitive reactance $X_C$ and voltage $V_C$ is the output or resonant capacitor, inductance 134 having reactance $X_{lamp}$ represents the inductance of the lamp choke shunt, coils 136 represent the lamp coil, and lamp 138 is the discharge lamp load. The lamp open circuit voltage is set by the lamp coil turn ratio and the system resonance gain which must be high enough for the lamp to strike. After the lamp ignites, its initial voltage will drop to approximately 10% of its steady state value. This low voltage will cause the lamp to draw more current which is limited by the leakage reactance of the lamp shunts. The lamp current $I_{lamp}$ can be calculated as follows:

$$I_{lamp}=(V_C-V_{lamp})/X_{lamp} \quad (1)$$

By the proper choice of $X_{lamp}$, the lamp current $I_{lamp}$ will be limited to a predetermined maximum value. This initial increase in current is desirable for warming up the lamp faster which in turn prolongs the operating life of the lamp 138. As the lamp temperature and voltage reach steady state values, the lamp current will reduce to its rated value as determined by equation (1). The ferroresonant transformer ballast will regulate the lamp output by keeping the output capacitor voltage $V_C$ level constant in the same manner as does a constant voltage ferroresonant transformer. Since all of the right-hand side terms of equation (1) are constant, it follows that the lamp current $I_{lamp}$ will also be constant.

There are several advantages associated with ferroresonant transformer ballasts. First, the lamp high voltage is independent of the output capacitor voltage which makes it possible to use standard 660 volt capacitors for any lamp voltage which may vary from 300 volts rms for low power lamps to over 2000 volts rms for higher power lamps. The lamp shunts limit the lamp current to a predetermined maximum value and reduce the crest factor of the lamp current. Third, a low voltage isolated sensor winding added to the lamp coil allows a simple and safe method to monitor its voltage. Fourth, any type of lamination from low grade strip steel to high grade "EI" laminations may be employed.

The ferroresonant transformer ballasts of FIGS. 5–7 can be improved by providing a current feedback closed loop ferroresonant transformer which provides the user with full control over the lamp output. A controlled ferroresonant transformer varies the resonance gain without saturating the core by switching an external linear inductor in parallel with the output or resonant capacitor in order to simulate core saturation with respect to output voltage regulation. A control circuit detects both the lamp current and voltage, and varies the duty cycle of an AC power switch to generate an appropriate inductance and resonance gain in order to regulate the lamp output.

Figure 8:
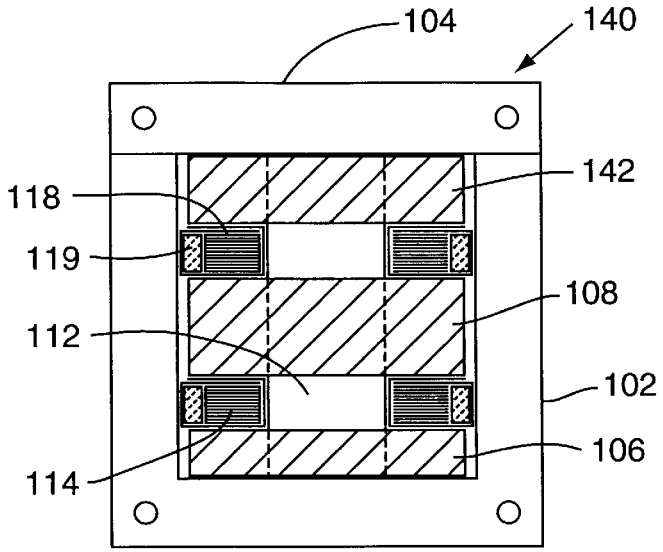
FIG. 8 PRIOR ART
FIG. 8 schematically illustrates a conventional controlled ferroresonant transformer.
Figure 9:
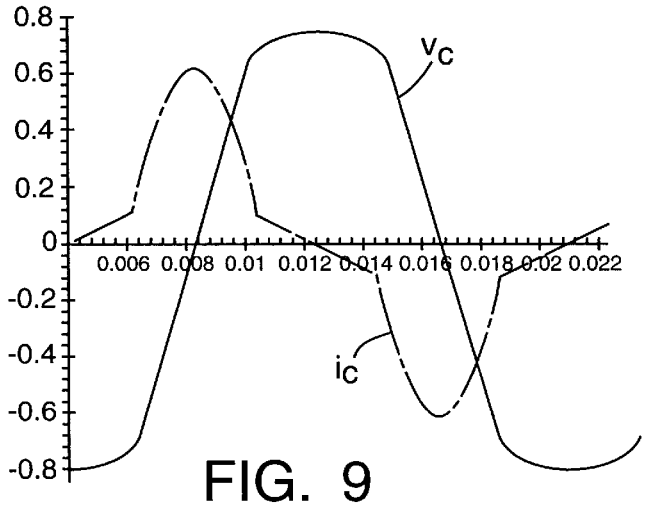
FIG. 9 PRIOR ART
FIG. 9 is an graph illustrating current and voltage waveforms associated with the output capacitor of the ferroresonant transformer of FIG. 8.
Figure 10:
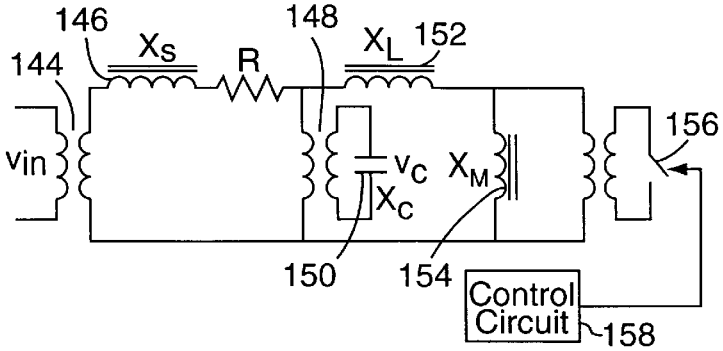
FIG. 10 PRIOR ART
FIG. 10 schematically illustrates an equivalent electrical circuit of the controlled ferroresonant transformer of FIG. 8.

To better understand the functioning of a controlled ferroresonant transformer ballast, reference will be made first to FIGS. 8–10 which illustrate prior controlled ferroresonant transformer technology. Turning first to FIG. 8, a controlled ferroresonant transformer 140 is shown where like elements are labeled by like reference numbers with respect to the ferroresonant transformer ballast of FIG. 5. A control inductance coil 142 replaces the lamp coil 110 of FIG. 5. This type of ferroresonant transformer is discussed more fully in U.S. Pat. No. 3,573,606 to Kakalec, and is used as a voltage regulator with a switched control inductor that simulates core saturation. FIG. 9 shows a plot of the output voltage $V_C$ and the capacitor current $i_C$. The equivalent electrical circuit of this controlled ferroresonant transformer is shown in FIG. 10 where coils 144 represent the input coil, inductance 146 having reactance $X_S$ is the leakage inductance, resistance R represents the equivalent DC resistance of all the windings, coils 148 represent the capacitor coil, capacitor 150 having reactance $X_C$ and voltage $V_C$ is the output capacitor, coil 152 having reactance $X_L$ represents a control inductance, coil 154 having reactance $X_M$ represents the magnetizing inductance, and switch 156 is preferably a solid state switch, operated by a control circuit 158 for switching the control inductance into and out of parallel relationship with the output capacitor 150 in order to simulate core saturation.

Figure 11:
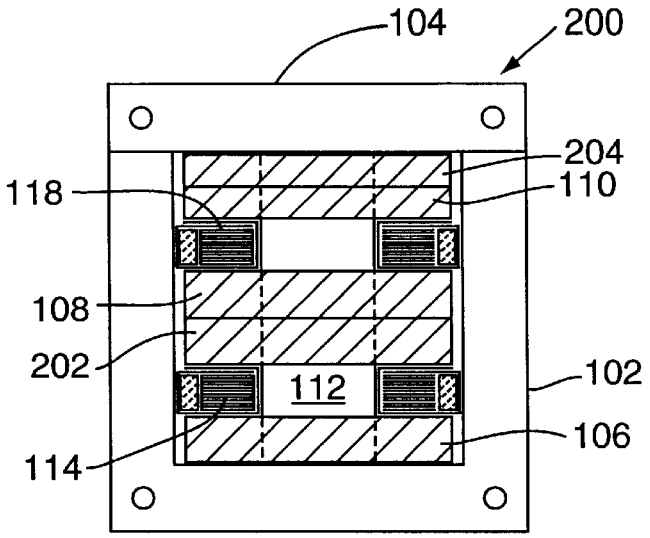
FIG. 11 schematically shows a controlled ferroresonant transformer ballast fabricated from E-shaped and I-shaped laminations according to a further embodiment of the present invention.
Figure 12:
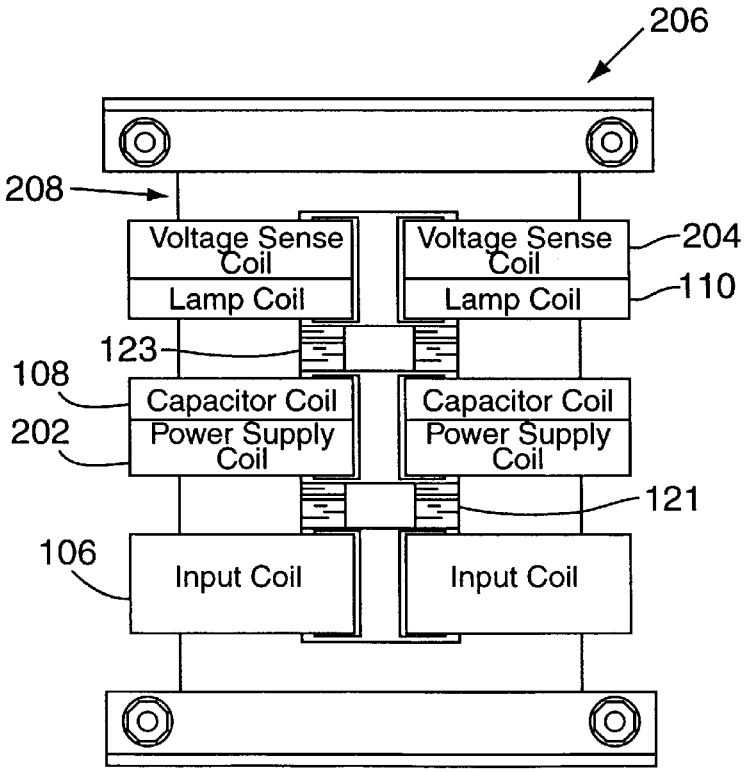
FIG. 12 schematically illustrates a controlled ferroresonant transformer ballast fabricated from strip steel according to yet another embodiment of the present invention.

Turning now to FIGS. 11–16, a controlled ferroresonant transformer ballast according to the present invention will be explained in detail where like elements with respect to the ferroresonant transformer of FIG. 8 are labeled with like reference numbers. With reference to FIG. 11, a controlled ferroresonant transformer ballast is generally designated by the reference number 200. The controlled ferroresonant transformer ballast 200 is different, in part, from the ferroresonant transformer of FIG. 8 with respect to the type and placement of windings around the center leg 112. The windings wound around the center leg 112 are an input coil 106, capacitor coil 108, power supply coil 202, lamp coil 110 and voltage sense coil 204. As can be seen in FIG. 11, the capacitor coil 108 and the power supply coil 202 generally occupy the same longitudinal position on the center leg 112 between a lamp choke shunt 118 and a leakage inductance shunt 114. The lamp coil 110 and voltage sense coil 204 generally occupy the same longitudinal position on the center leg 112 between the lamp choke shunt 118 and the I-shaped piece 104. As can be seen from FIG. 11, the controlled ferroresonant transformer ballast is fabricated from "EI" laminations. However, a controlled ferroresonant transformer ballast may also be fabricated from strip steel because of a low crest factor associated with the ferroresonant transformer ballast 200. As shown in FIG. 12, a controlled ferroresonant transformer ballast 206 employs strip steel for the core 208.

Figure 13:
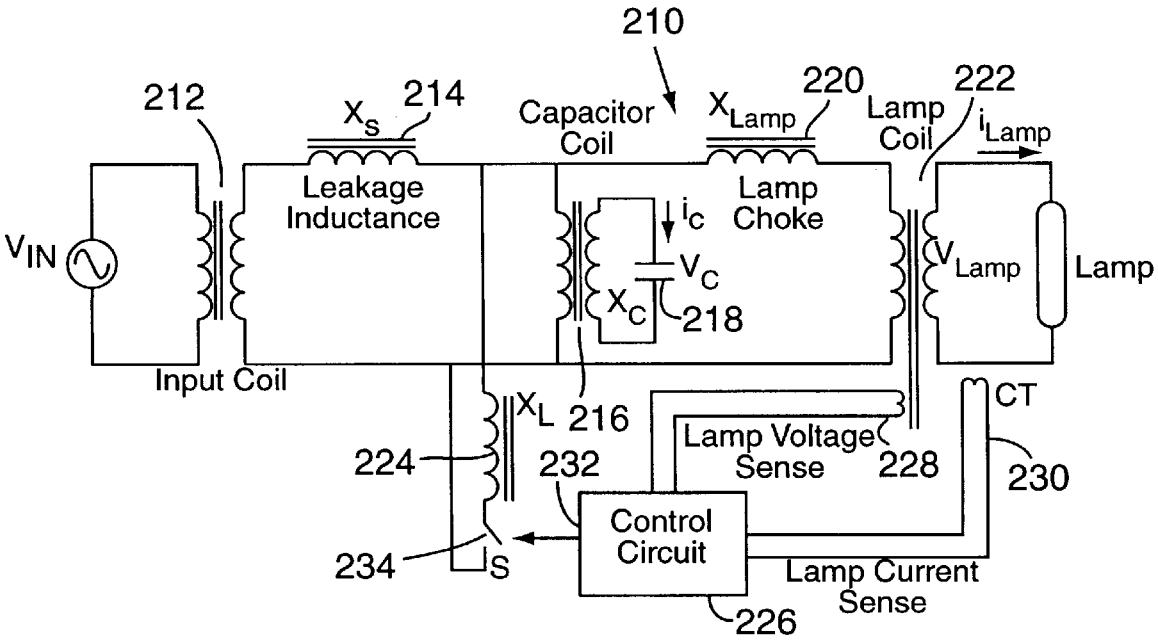
FIG. 13 schematically illustrates an equivalent electrical circuit of the controlled ferroresonant transformer ballast of FIGS. 11 and 12.

FIG. 13 schematically shows an equivalent electrical circuit 210 of the controlled ferroresonant transformer ballasts of FIGS. 11 and 12. Coils 212 represent the input coil, an inductance 214 having reactance $X_S$ represents the leakage inductance, coils 216 represent the capacitor coil, capacitor 218 having reactance $X_C$ and voltage $V_C$ is the output capacitor, coil 220 having reactance $X_{lamp}$ is the inductance of the lamp shunt, coils 222 represent the lamp coil,, and coil or inductor 224 having reactance $X_L$ represents an external switched inductor. A control circuit 226 receives inputs from a lamp voltage sensor 228 and lamp current sensor 230 and has a control output 232 for opening and closing a switch 234 to switch the inductor 224 into and out of parallel relationship with the output capacitor 218 in response to the sensors 228 and 230 in order to simulate core saturation.

The operation of the controlled ferroresonant transformer ballast embodied in FIGS. 11–13 consists of three stages: ignition, warm-up and steady state. With respect to the ignition stage: at start-up, the control circuit 226 forces the lamp open circuit voltage to rise to a maximum value in order to strike the lamp. During warm-up, the control circuit 226 will sense the lamp low voltage and increase its current by keeping the switch 234 open for as long as $V_{lamp}$ is below its steady state value. As the lamp warms-up, its $V_{lamp}$ will increase and the control circuit 226 will gradually increase the duty cycle of the switch 234 bringing the lamp current to its rated value by reducing the equivalent capacitive reactance $X_{eq}=X_L$ in parallel with $X_C$. After the lamp reaches its steady state value, the control circuit 226 will sense the lamp current via the lamp current sensor 230 and maintain the lamp current at a constant value independently of the input voltage $V_{IN}$.

Figure 14:
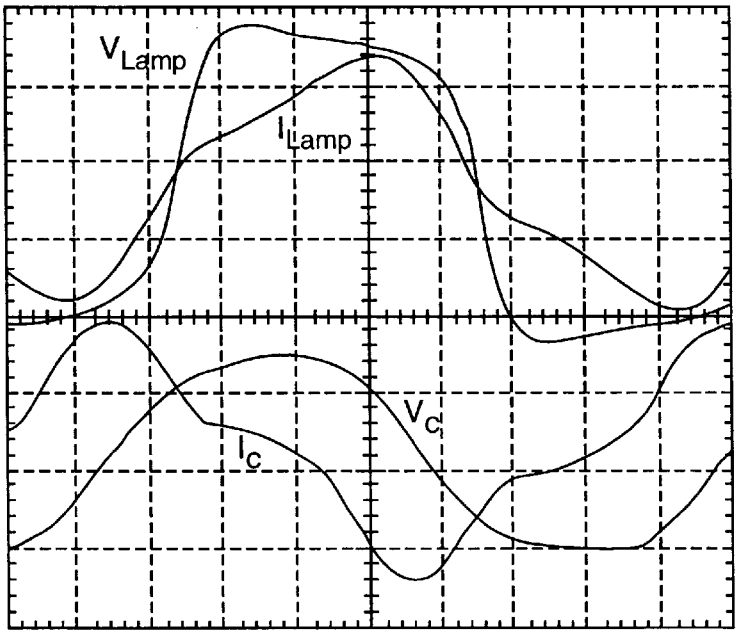
FIG. 14 is a graph illustrating various voltage and current waveforms of an output capacitor and lamp associated with a controlled ferroresonant transformer ballast in accordance with the present invention.

FIG. 14 is a plot of the various waveforms $V_{lamp}$, $I_{lamp}$, $V_C$ and $I_C$ of the controlled ferroresonant transformer ballast depicted by the equivalent electrical circuit of FIG. 13. Important advantages in utilizing a controlled ferroresonant transformer ballast is a low crest factor of the lamp current which is critical for the employment of metal-additive gas discharge lamps, and a high input power factor which is a characteristic of all ferroresonant transformers.

Figure 15:
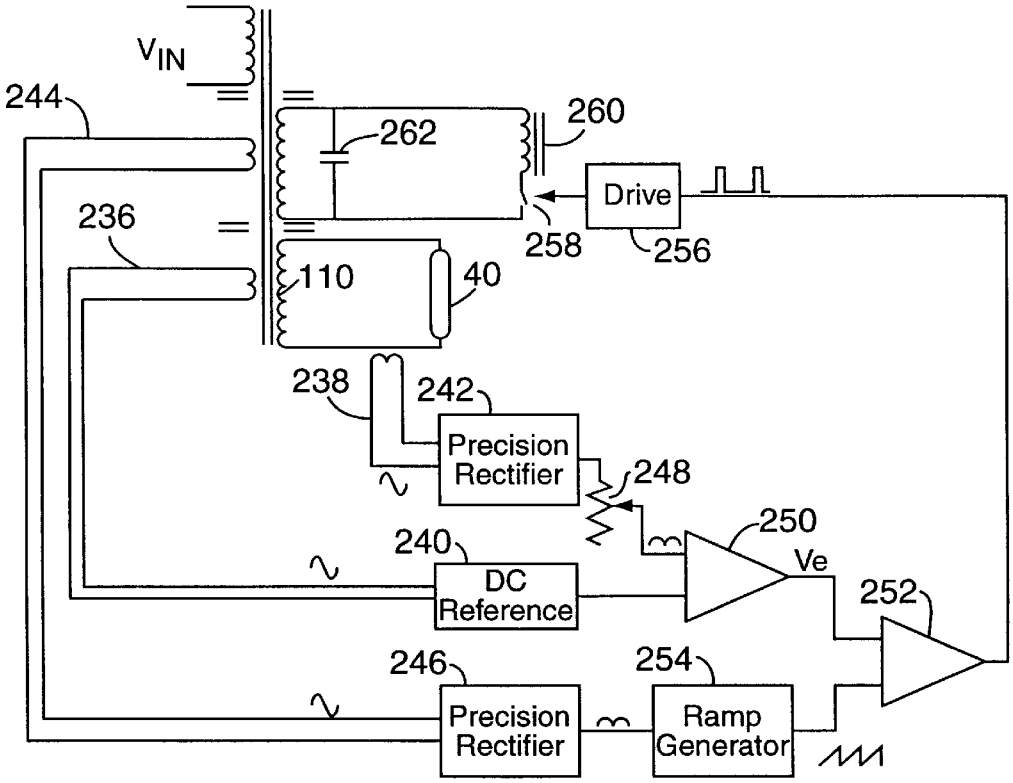
FIG. 15 is a schematic illustrates an embodiment of a control circuit used in conjunction with a controlled ferroresonant transformer ballast.

FIG. 15 schematically illustrates an embodiment of the control circuit 226 of FIG. 13 used in conjunction with a ferroresonant transformer to form a controlled ferroresonant ballast 235 embodying the present invention. The control circuit includes a lamp voltage sensor 236 preferably wound around a magnetic core of the ferroresonant transformer ballast 235 to sense the lamp voltage, and further includes a lamp current sensor 238 preferably positioned adjacent to the supply line to the lamp in order to sense the lamp current. The lamp voltage sensor 236 is coupled to an input of a DC reference module 240, and the lamp current sensor 238 is coupled to an input of a first rectifier 242. A power supply coil 244 is coupled to an input of a second rectifier 246. An output of the first rectifier 242 is coupled via a potentiometer 248 to a first input of an error amplifier 250. An output of the DC reference module 240 is coupled to a second input of the error amplifier 250. An output of the error amplifier 250 is coupled to a first input of a comparator 252. A ramp generator 254 has an input coupled to an output of the second rectifier 246, and an output coupled to a second input of the comparator 252. An output of the comparator 252 is coupled to an input of a drive circuit or buffer 256. An output of the drive circuit 256 is coupled a control input of a switch 258, such as the gate of a silicon-controlled rectifier switch, which is coupled in series with a switched control inductor 260. The control inductor 260 is electrically coupled in parallel with an output capacitor 262 of a ferroresonant transformer ballast circuit when the switch 258 is closed.

The operation of the control circuit of FIG. 15 will now be explained with respect to the three lamp operating stages: ignition, warm-up and steady state. During the ignition stage, the average lamp voltage rises with that of the output capacitor, and the lamp current is zero before the lamp ignites.

The operation of the control circuit of FIG. 15 will now be explained with respect to the three stages of a ferroresonant ballast: ignition, warm-up and steady state. During the ignition stage, the lamp voltage sensor 236 and the lamp current sensor 238 respectively generate voltage signals proportional to the voltage level across the lamp 40 and the current level flowing through the lamp. Because the lamp 40 has not yet been ignited, the current flowing through the lamp 40 is approximately zero amps, and therefore the voltage level generated by the current sensor is approximately zero volts. Consequently, the difference between the voltage signals generated by the voltage sensor 236 and the current sensor 238 is a relatively high value which is amplified by the error amplifier to produce an error signal $V_e$. An alternating voltage is induced in the power supply coil 244 which is in turn rectified by the second rectifier 246. The rectified voltage signal is then input into the ramp generator 254 to produce a sawtooth signal having a period equal to one half of the alternating input signal supplied to the ferroresonant transformer at the input coil. The relatively high $V_e$ signal and the ramp signal are then input into the comparator 252. The comparator generates a digital output of "1" (i.e., output goes high) during the portion of the ramp signal cycle when the ramp signal rises above the level of $V_e$. Because $V_e$ is a relatively high signal before ignition, the ramp signal generally does not rise above the level of $V_e$. Consequently, the output of the comparator remains at a digital output of "0" (i.e., output remains low), and the switch 258 remains open so that no current can be diverted from the output capacitor 262 to the switched control inductor 260. Therefore, full current can be directed to charge the output capacitor 262 so that the voltage across the output capacitor 262 may rise. Because the lamp coil 110 is magnetically coupled to the capacitor coil 108, as the voltage across the output capacitor 262 rises, the voltage across the lamp 40 also rises until the lamp voltage level is high enough to strike the lamp (i.e., turn the lamp on).

During the warm-up stage immediately after ignition of the gas discharge lamp 40, $V_{lamp}$ drops in voltage, $I_{lamp}$ is high, and in turn $V_e$ is relatively high such that the switch 258 remains open to increase $I_{lamp}$ for as long as $V_{lamp}$ is below its steady state value. As the lamp warms-up, its voltage $V_{lamp}$ will increase, which in turn will decrease $V_e$ generated by the error amplifier 250. As $V_e$ decreases, the portion of each cycle of the ramp signal which is at a higher level than that of $V_e$ will increase resulting in the comparator being turned high for a greater portion of each cycle of the ramp signal. As a consequence, the drive circuit 256 closes the switch 258 for an increasingly greater portion of each cycle of the ramp signal (i.e., the duty cycle of the switch 262 increases). Increasing the duty cycle of the switch 258 brings the lamp 40 current to its rated value by reducing the equivalent capacitive reactance $X_{eq}=X_L$ in parallel with $X_C$. After the lamp 40 reaches steady state, the control circuit will sense the lamp current and maintain it at a constant level independently of the input voltage received from the input coil.

Figure 16:
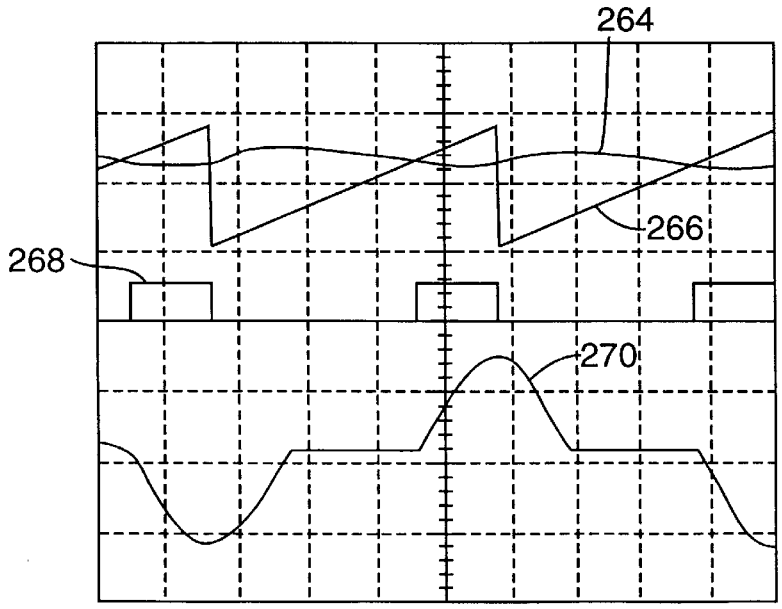
FIG. 16 is a graph further illustrating various waveforms associated with a controlled ferroresonant transformer ballast in accordance with the present invention.

FIG. 16 is a graph of an error amplifier voltage signal 264, a ramp generator voltage signal 266, switch control or gate voltage signal 268 and control inductor current signal 270. As can be seen in FIG. 16, when the voltage of the ramp signal 266 rises above that of the error signal 264, the gate signal 268 used for controlling a silicon-controlled switch is activated in response to the comparator 252 going high in order to allow current (as shown by the inductor signal 270) to flow through the control inductor 260.

The lamp current may be adjusted by components (not shown) for varying the reference voltage of the error amplifier. Such components may be, for example, logic control switched resistors and opto-isolators which interface with PLCs.

While the present invention has been described in several preferred embodiments, it will be understood that numerous modifications and substitutions can be made without departing from the spirit or scope of the invention. Accordingly, the present invention has been described in several preferred embodiments by way of illustration, rather than limitation, and the scope of this patent disclosure shall not be determined primarily from the scope of the appended claims.

What is claimed is:

1. A ferroresonant transformer ballast for regulating the current of gas discharge lamps, the ballast comprising:

a magnetic core;

a first coil wound about the magnetic core and energizable from a variable source for supplying a changing input voltage and current;

a second coil wound about the magnetic core and magnetically coupled to the first coil so as to induce a voltage across terminals of the second coil in response to a change in current from the first coil;

an output capacitor connected across the terminals of the second coil for resonance;

a third coil wound about the magnetic core and magnetically coupled to the second coil so as to induce a voltage across terminals of the third coil in proportion to the average voltage across the output capacitor;

at least one gas discharge lamp connected across terminals of the third coil whereby voltage across the gas discharge lamp is regulated in response to the average voltage of the output capacitor;

a control inductor to be switchably coupled in electrically parallel relationship with the output capacitor; and means for switching the control inductor in a pulsing manner into and out of parallel relationship with the output capacitor in response to a current level of the gas discharge lamp to substantially maintain the current level of the gas discharge lamp at a predetermined value when the lamp is operating in a steady state mode, the switching means including a switch having terminals coupled in series with the control inductor.

2. A ferroresonant transformer ballast as defined in claim 1, further including:

a first magnetic shunt extending from the magnetic core at a longitudinal position between the first and second coils, the first shunt serving as a leakage inductance shunt; and a second magnetic shunt extending from the magnetic core at a longitudinal position between the second and third coils, the second shunt serving as a lamp choke shunt.

3. A ferroresonant transformer ballast as defined in claim 1, wherein the magnetic core comprises cooperating E-shaped and I-shaped pieces, the I-shaped piece positioned across free ends of the E-shaped piece to form a three-legged magnetic core, the first, second and third coils being wound about a center leg of the three-legged magnetic core.

4. A ferroresonant transformer ballast as defined in claim 3, wherein the first and second magnetic shunts each extend outwardly from the center leg toward opposing portions of outer legs of the magnetic core, the magnetic shunts and the opposing portions of the outer legs of the magnetic core cooperating to form air gaps therebetween.

5. A ferroresonant transformer ballast as defined in claim 1, wherein the magnetic core is fabricated from strip steel.

6. A ferroresonant transformer ballast for regulating the current across gas discharge lamps, the ballast comprising:

a three-legged magnetic core having a center leg and outer legs;

a first coil wound about the center leg of the magnetic core for supplying a changing input voltage;

a second coil wound about the center leg of the magnetic core whereby the second coil is magnetically coupled to the first coil so as to induce a voltage across terminals of the second coil in response to a change in current from the first coil;

an output capacitor connected across the terminals of the second coil for resonance;

a third coil wound about the center leg of the magnetic core whereby the third coil is magnetically coupled to the second coil so as to induce a voltage across terminals of the third coil in proportion to the average voltage across the output capacitor;

a gas discharge lamp connected across terminals of the third coil whereby a current of the gas discharge lamp is regulated in response to the average voltage of the output capacitor;

a control inductor to be switchably coupled in electrically parallel relationship with the output capacitor; and means for switching the control inductor in a pulsing manner into and out of parallel relationship with the output capacitor in response to a current level of the gas discharge lamp to substantially maintain the current level of the gas discharge lamp when the lamp is operating in a steady state mode, the switching means including a switch having terminals coupled in series with the control inductor.

7. A ferroresonant transformer ballast as defined in claim 1, wherein the switching means includes a voltage sensor coil wound about the core and a current sensor coil positioned adjacent the lamp coil, the switch being opened and closed in response to current and voltage levels detected by the voltage and current sensors.

8. A ferroresonant transformer ballast as defined in claim 1, wherein the switching means further includes:

a power supply coil wound about the magnetic core generally at a longitudinal position occupied by the capacitor coil whereby the power supply coil is magnetically coupled to the capacitor coil so as to induce a voltage across terminals of the power supply coil in proportion to the average voltage level across the output capacitor;

a voltage sensor positioned adjacent the lamp coil for generating a voltage level in proportion to a voltage level across the gas discharge lamp;

a current sensor positioned adjacent to a current path of the lamp for generating a voltage level in proportion to a current level flowing through the lamp;

a first rectifier having an input coupled to the current sensor;

a DC reference module having an input coupled to the voltage sensor;

a second rectifier having an input coupled to power supply coil;

a differential or error amplifier having a first input coupled to the output of the first rectifier, a second input coupled to an output of the DC reference module, and an output for generating an error voltage signal;

a ramp generator having an input coupled to an output of the second rectifier, and an output for generating a ramp signal; and a voltage comparator having a first input coupled to the output of the error amplifier, a second input coupled to the output of the ramp generator, and an output coupled to a control terminal of the switch.

9. A ferroresonant transformer ballast as defined in claim 8, wherein the switching means further includes a drive circuit interposed between the voltage comparator and the control terminal of the switch.

10. A ferroresonant transformer ballast as defined in claim 8, further including a variable resistor interposed between the output of the first rectifier and the input of the error amplifier.

11. A ferroresonant transformer ballast as defined in claim 1, wherein the switch is a silicon-controlled switch.

12. A ferroresonant transformer ballast as defined in claim 6, further including:

a first magnetic shunt extending outwardly from the center leg of the magnetic core at a longitudinal position between the first and second coils, the first shunt serving as a leakage inductance shunt; and a second magnetic shunt extending outwardly from the center leg of the magnetic core at a longitudinal position between the second and third coils, the second shunt serving as a lamp choke shunt.

13. A ferroresonant transformer ballast as defined in claim 6, wherein the magnetic core comprises cooperating E-shaped and I-shaped pieces, the I-shaped piece positioned across free ends of the E-shaped piece to form a three-legged magnetic core.

14. A ferroresonant transformer ballast for regulating the current level of gas discharge lamps, the ballast comprising:

a magnetic core including cooperating E-shaped and I-shaped pieces, the I-shaped piece positioned across free ends of the E-shaped piece to form a three-legged magnetic core having a center leg and outer legs;

a first coil wound about the center leg of the magnetic core for supplying a changing input voltage;

a second coil wound about the center leg of the magnetic core whereby the second coil is magnetically coupled to the first coil so as to induce a voltage across terminals of the second coil in response to a change in current from the first coil;

an output capacitor connected across the terminals of the second coil for resonance;

a third coil wound about the center leg of the magnetic core whereby the third coil is magnetically coupled to the second coil so as to induce a voltage across terminals of the third coil in proportion to the average voltage across the output capacitor;

a gas discharge lamp connected across terminals of the third coil whereby a current level of the gas discharge lamp is regulated in response to the average voltage of the output capacitor;

a first magnetic shunt extending outwardly from the center leg of the magnetic core at a longitudinal position between the first and second coils, the first shunt serving as a leakage inductance shunt;

a second magnetic shunt extending outwardly from the center leg of the magnetic core at a longitudinal position between the second and third coils, the second shunt serving as a lamp choke shunt;

a control inductor to be switchably coupled in electrically parallel relationship with the output capacitor; and means for switching the control inductor in a pulsing manner into and out of parallel relationship with the output capacitor in response to a current level of the gas discharge lamp to substantially maintain the current level of the gas discharge lamp at a predetermined value when the lamp is operating in a steady state mode, the switching means including a switch having terminals coupled in series with the control inductor.

* * * * *